US009539695B2

(12) United States Patent
Pietsch et al.

(10) Patent No.: US 9,539,695 B2
(45) Date of Patent: Jan. 10, 2017

(54) CARRIER, METHOD FOR COATING A CARRIER, AND METHOD FOR THE SIMULTANEOUS DOUBLE-SIDE MATERIAL-REMOVING MACHINING OF SEMICONDUCTOR WAFERS

(75) Inventors: Georg Pietsch, Burghausen (DE); Michael Kerstan, Burghausen (DE); Heiko aus dem Spring, Weilburg (DE)

(73) Assignees: Siltronic AG, Munich (DE); Peter Wolters GmbH, Rendsburg (DE)

( * ) Notice: Subject to any disclaimer, the term of this patent is extended or adjusted under 35 U.S.C. 154(b) by 2567 days.

(21) Appl. No.: 12/242,963

(22) Filed: Oct. 1, 2008

(65) Prior Publication Data

US 2009/0104852 A1 Apr. 23, 2009

(30) Foreign Application Priority Data

Oct. 17, 2007 (DE) ..... 10 2007 049 811

(51) Int. Cl.

| | |
|---|---|
| ***B24B 37/08*** | (2012.01) |
| ***B24B 37/28*** | (2012.01) |
| ***B24B 37/32*** | (2012.01) |
| ***B24B 37/04*** | (2012.01) |

(52) U.S. Cl.

CPC ..... *B24B 37/28* (2013.01); *B24B 37/042* (2013.01); *B24B 37/08* (2013.01); *B24B 37/32* (2013.01); *Y10T 29/49* (2015.01)

(58) Field of Classification Search

CPC ..... B24B 37/042; B24B 37/08; B24B 37/28; B24B 37/32; B24B 7/17; Y10T 29/49

USPC ..... 451/41, 262, 285, 286, 287, 290, 397,451/398

See application file for complete search history.

(56) References Cited

U.S. PATENT DOCUMENTS

| | | | | |
|---|---|---|---|---|
| 4,739,589 | A * | 4/1988 | Brehm et al. | 451/41 |
| 5,085,009 | A * | 2/1992 | Kinumura et al. | 451/291 |
| 5,882,245 | A * | 3/1999 | Popovich et al. | 451/41 |
| 6,007,407 | A | 12/1999 | Rutherford et al. | |
| 6,019,672 | A | 2/2000 | Damgaard | |

(Continued)

FOREIGN PATENT DOCUMENTS

| | | |
|---|---|---|
| DE | 10007390 A1 | 10/2000 |
| DE | 10250823 B4 | 2/2005 |

(Continued)

OTHER PUBLICATIONS

Roland Clar, "Zweischeiben-Lappen and Feinschleifen", Feinwerktechnik & Messtechnik 90 (1982) 5, pp. 242-244.

(Continued)

*Primary Examiner* — Eileen Morgan
(74) *Attorney, Agent, or Firm* — Brooks Kushman P.C.

(57) ABSTRACT

Carriers suitable for receiving one or more semiconductor wafers for the machining thereof in lapping, grinding or polishing machines, comprise a core of a first material which has a high stiffness, the core being completely or partly coated with a second material, and also at least one cutout for receiving a semiconductor wafer, wherein the second material is a thermoset polyurethane elastomer having a Shore A hardness of 20-90. The carriers are preferably coated with the second material after chemical surface activation and application of adhesion promoter, and may be used for simultaneous double-side material-removing machining of a plurality of semiconductor wafers.

26 Claims, 3 Drawing Sheets

(56) References Cited

U.S. PATENT DOCUMENTS

| | | | | |
|---|---|---|---|---|
| 6,042,688 | A * | 3/2000 | Masumura et al. | 156/345.14 |
| 6,096,107 | A | 8/2000 | Caracostas et al. | |
| 6,117,776 | A | 9/2000 | Huber et al. | |
| 6,299,514 | B1 | 10/2001 | Boller | |
| 6,514,424 | B2 * | 2/2003 | Wenski et al. | 216/38 |
| 6,599,177 | B2 | 7/2003 | Nevoret et al. | |
| 2002/0052064 | A1 | 5/2002 | Grabbe et al. | |
| 2004/0067723 | A1 | 4/2004 | Ensinger | |
| 2004/0198193 | A1 * | 10/2004 | Tajima et al. | 451/41 |
| 2005/0202758 | A1 * | 9/2005 | Yoshida et al. | 451/41 |
| 2007/0184662 | A1 | 8/2007 | Yamashita et al. | |
| 2008/0166952 | A1 * | 7/2008 | Ueno | 451/41 |
| 2008/0318493 | A1 * | 12/2008 | Aida | 451/36 |
| 2010/0048105 | A1 | 2/2010 | Fletcher et al. | |

FOREIGN PATENT DOCUMENTS

| | | | | |
|---|---|---|---|---|
| DE | 10344602 | A1 | 5/2005 | |
| EP | 0197214 | A2 | 10/1986 | |
| EP | 0208315 | B1 | 9/1990 | |
| JP | 57041164 | A | 3/1982 | |
| JP | 60197366 | A | 10/1985 | |
| JP | 9-207064 | A | 8/1997 | |
| JP | 10329013 | A | 12/1998 | |
| JP | 11033895 | A | 2/1999 | |
| JP | 2000127030 | A | 5/2000 | |
| JP | 2000280167 | A * | 10/2000 | B24B 37/04 |
| JP | 2000288922 | A | 10/2000 | |
| JP | 2001287155 | A | 10/2001 | |
| JP | 2003305637 | A | 10/2003 | |
| JP | 2004154919 | A | 3/2004 | |
| JP | 2004114208 | A | 4/2004 | |
| JP | 2007098543 | A | 4/2007 | |
| JP | 2007245571 | A | 9/2007 | |
| JP | 2010510083 | A | 4/2010 | |
| KR | 2001-0104243 | B1 | 11/2001 | |
| TW | 391040 | | 5/1997 | |
| TW | 200531790 | | 10/2002 | |
| WO | 2006/090661 | A1 | 8/2006 | |

OTHER PUBLICATIONS

Jan Haisma et al., "Improved Geometry of Double-Sided Polished Parallel Wafers Prepared for Direct Wafer Bonding", Applied Optics, vol. 33, No. 34, (1994), p. 7945.

* cited by examiner

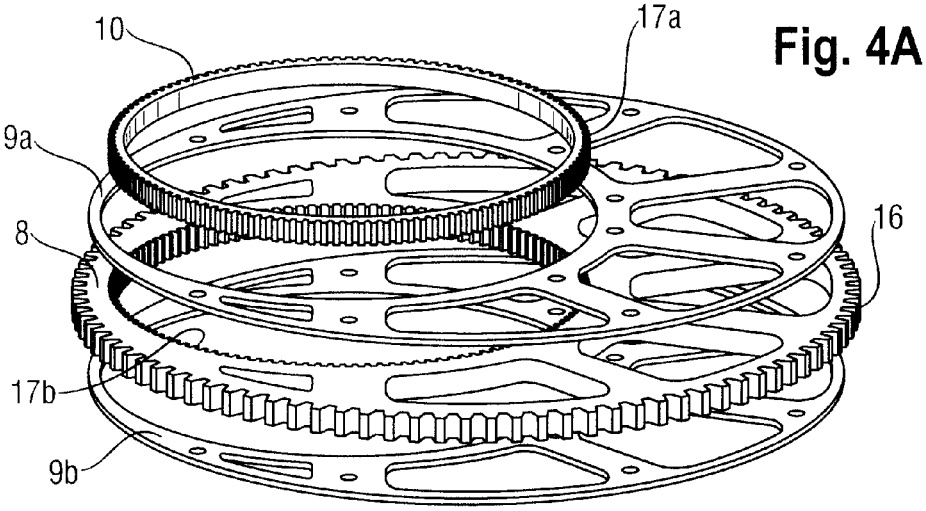
Fig. 4A
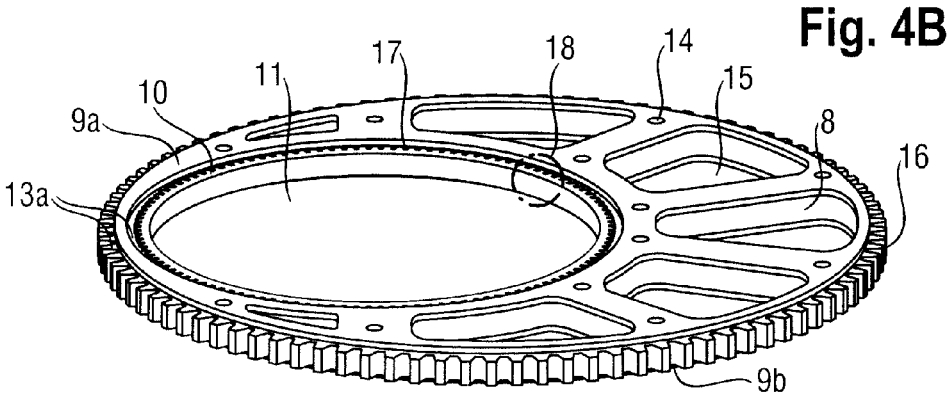
Fig. 4B
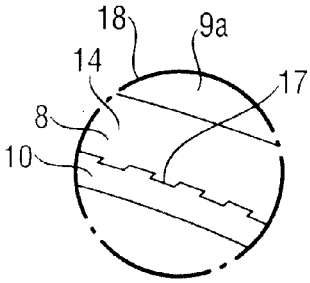
Fig. 4C
Fig. 4D
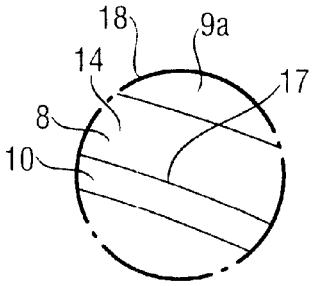
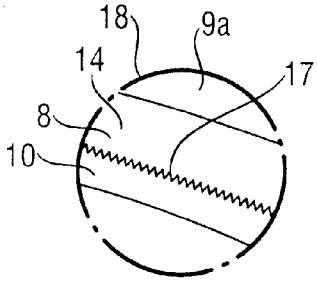
Fig. 4E

CARRIER, METHOD FOR COATING A CARRIER, AND METHOD FOR THE SIMULTANEOUS DOUBLE-SIDE MATERIAL-REMOVING MACHINING OF SEMICONDUCTOR WAFERS

BACKGROUND OF THE INVENTION

1. Field of the Invention

The invention relates to a carrier for receiving semiconductor wafers for the machining thereof in grinding, polishing and lapping machines, a method for coating a carrier, and also a method for the simultaneous double-side material-removing machining (lapping, grinding or polishing) of semiconductor wafers using such carriers.

2. Background Art

Electronics, microelectronics and microelectromechanics require as starting materials (substrates) semiconductor wafers with extreme requirements of global and local flatness, front-side-referenced local flatness (nanotopology), roughness, cleanliness and freedom from impurity atoms, in particular metals. Semiconductor wafers are wafers made of semiconductor materials such as compound semiconductors, for example, gallium arsenide, or elemental semiconductors such as principally silicon and occasionally germanium or else layer structures thereof. Layer structures are for example a device-carrying silicon upper layer on an insulating interlayer ("silicon on insulator", SOI), or a lattice-strained silicon upper layer on a silicon/germanium interlayer with germanium proportion increasing toward the upper layer, on a silicon substrate ("strained silicon", s-Si), or combinations of the two ("strained silicon on insulator", sSOI). Semiconductor materials are preferably used in monocrystalline form for electronic components, and are preferably used in polycrystalline form for solar cells (photovoltaics).

In order to produce the semiconductor wafers in accordance with the prior art, a semiconductor ingot is produced which is firstly separated into thin wafers, usually by means of a multiwire saw ("multiwire slicing", MWS). This is followed by one or more machining steps which can generally be classified into the following groups:

a) mechanical machining;
b) chemical machining;
c) chemomechanical machining;
d) if appropriate production of layer structures.

A multiplicity of secondary steps such as edge machining, cleaning, sorting, measuring, thermal treatment, packaging, etc. are also used.

Mechanical machining steps in accordance with the prior art are lapping (simultaneous double-side lapping of a plurality of semiconductor wafers in a "batch"), single-side grinding of individual semiconductor wafers with single-side clamping of the workpieces (usually carried out as sequential double-side grinding; "single-side grinding", SSG; "sequential SSG") or simultaneous double-side grinding of individual semiconductor wafers between two grinding disks (simultaneous "double-disk grinding", DDG).

Chemical machining comprises etching steps such as alkaline, acidic or combination etches.

Chemomechanical machining comprises polishing methods in which material removal is obtained by means of relative movement of semiconductor wafer and polishing cloth under pressure while supplying a polishing slurry (for example an alkaline silica sol). The prior art describes batch double-side polishing (DSP) and batch and individual wafer single-side polishing (mounting of the semiconductor wafers by means of vacuum, adhesive bonding or adhesion during the polishing machining on one side on a support).

For producing highly planar semiconductor wafers, particular importance is ascribed to those machining steps in which the semiconductor wafers are machined largely in a constrained-force-free manner in "free-floating" fashion without force-locking or positively locking clamping ("free-floating processing", FFP). Undulations such as are produced for example by thermal drift or alternating load in MWS are eliminated particularly rapidly, by FFP with little loss of material.

FFP known in the prior art include lapping, DDG and DSP, where DDG will not be considered in the context of this invention due to different kinematics. A lapping method is disclosed e.g. in Feinwerktechnik & Messtechnik 90 (1982) 5, pp. 242-244, while a DSP method is described e.g. in Applied Optics 33 (1994) 7945.

DE 103 44 602 A1 discloses a further mechanical FFP method in which a plurality of semiconductor wafers lie in a respective cutout of one of a plurality of carriers that are caused to effect rotation by means of a ring-shaped outer and a ring-shaped inner drive ring, and are thereby held on a specific geometrical path and machined in material-removing fashion between two rotating working disks coated with bonded abrasive. This method is also termed "Planetary Pad Grinding" or simply PPG. The abrasive is composed of a film or "cloth" bonded to the working disks of the apparatus used, as disclosed in U.S. Pat. No. 6,007,407, for example.

Hard substances are used as the abrasive, e.g. diamond, silicon carbide (SiC), cubic boron nitride (CBN), silicon nitride ($Si_3N_4$), cerium dioxide ($CeO_2$), zirconium dioxide ($ZrO_2$), corundum/aluminum oxide/sapphire ($Al_2O_3$) and many other ceramics having grain sizes of less than 1 micrometer up to a few tens of micrometers. For the machining of silicon in particular, diamond is preferred, and furthermore also $Al_2O_3$, SiC and $ZrO_2$. The diamond is incorporated as individual grains or bonded by means of a ceramic, metallic or synthetic resin primary bond to form conglomerates, into the ceramic, metal or synthetic resin matrix of the abrasive bodies.

DE 103 44 602 A1 discloses a method in which either a multiplicity of abrasive bodies containing bonded abrasive are bonded to the working disks or in which the abrasive is bonded in a layer or a "cloth" and cloths of this type are bonded to the working disk. The working layer may also be adfixed by means of vacuum, screwing, covering or by means of hook and loop fastening, or in electrostatic or magnetic fashion (see e.g. U.S. Pat. No. 6,019,672 A). Sometimes the working layers are embodied as cloths or laminated sheets (U.S. Pat. No. 6,096,107 A, U.S. Pat. No. 6,599,177 B2).

Sheets having structured surfaces are also known, comprising elevated regions that come into contact with the workpiece and recessed regions via which cooling lubricant can be supplied and abrasive slurry and spent grain can be discharged. An abrasive tool (abrasive cloth) structured in this way is disclosed by U.S. Pat. No. 6,007,407 A, for example. Here the abrasive cloth is self-adhesive on the rear side, which permits a simple change of the abrasive tool on the working disk.

Suitable apparatuses for carrying out the machining methods (lapping, DSP and PPG) appertaining to the invention essentially comprise a ring-shaped upper and lower working disk and a rolling apparatus comprising toothed rings arranged on the inner edge and on the outer edge of the ring-shaped working disks. Upper and lower working disks and inner and outer toothed rings are arranged concentrically and have collinear drive axes. The workpieces are introduced into thin guide cages which are toothed on the outside, so-called "carriers", which are moved between the two working disks during machining by means of the rolling apparatus.

In the case of PPG, the working disk comprises, as mentioned above, a working layer with fixedly bonded abrasive. In the case of lapping, use is made of working disks, so-called lapping plates, composed of cast material, generally a steel casting, e.g. ductile gray cast iron. These contain in addition to iron and carbon a multiplicity of nonferrous metals in different concentrations. In the case of DSP, the working disks are covered with a polishing cloth, wherein the polishing cloth is composed for example of a thermoplastic or heat-curable polymer. A foamed plate or a felt or fiber substrate which is impregnated with a polymer is also suitable. In the case of lapping and DSP, lapping and polishing agents, respectively, are additionally supplied.

For lapping, oils, alcohols and glycols are known as carrier liquids for the lapping agent (abrasive substance slurry, abrasive substances), also called slurry. For DSP, aqueous polishing agents to which silica sol is applied are known, which are preferably alkaline and, if appropriate, contain further additives such as chemical buffer systems, surfactants, complexing agents, alcohols and silanols.

In the prior art, carriers are known which comprise, e.g., disks composed of a first hard, stiff material, e.g. steel, in particular high-grade steel, which are toothed on the outside appropriately to match the rolling apparatus, have holes in their surface for passage of the cooling lubricant, and one or more cutouts for receiving one or more semiconductor wafers, wherein the cutouts for receiving the semiconductor wafers are usually lined with a second, softer material.

These linings are introduced loosely into the cutouts (JP 57041164) or fixed in the latter (EP 0 197 214 A2). Fixing can be effected by adhesive bonding or positive locking, if appropriate with support by enlarged contact areas (corresponding polygons in cutout and lining) or else by anchoring by means of corresponding undercuts ("dovetail") (EP 0 208 315 B1).

Materials known in the prior art for the lining are e.g. polyvinyl chloride (PVC), polyethylene (PE), polypropylene (PP), polytetrafluoroethylene (PTFE) (EP 0 208 315 B1), and also polyamide (PA), polystyrene (PS) and polyvinylidene difluoride (PVDF).

Carriers are likewise known which are produced from only a single, sufficiently stiff material, e.g. a high-performance plastic or a plastic having a reinforcement made of e.g. glass, carbon or synthetic fibers (JP 2000127030 A2). U.S. Pat. No. 5,882,245 discloses carriers composed of polyether ether ketone (PEEK), polyaryl ether ketone (PAEK), polyetherimide (PEI), polyimide (PI), polyether sulfone (PES), polyamideimide (PAI), polyphenylene sulfide (PPS), polyethylene terephthalate (PET), polybutylene terephthalate (PBT), acetal homopolymer (POM-H), acetal copolymer (POM-C), liquid crystal polymer (LCP), and epoxy (EP). U.S. Pat. No. 5,882,245 also discloses carriers having applied protective coats of lacquer based on epoxy (EP), epoxy-acrylate mixture (EP/AC), polyurethane-acrylate mixture (PU/AC) or epoxy-acrylate-polyurethane (EP/AC/PU).

For application in the case of lapping, usually a single-layered steel or high-grade steel carrier with or without a lining is used (cf. DE 102 50 823 B4). Owing to the aggressive, less selective material-removing free lapping grain in the lapping slurry, the steel or high-grade steel carriers are subject to a high degree of wear.

The wear can be reduced somewhat if the thickness of the carriers is chosen to be significantly thinner than the final thickness of the semiconductor wafers. In this case, however, it is still at least 0.2-0.4 μm per lapping procedure with 90 μm target removal of material from the semiconductor wafers.

Owing to the continuous and considerable decrease in the thickness of the carriers, there is a continuous increase in the residual overhang of the semiconductor wafers upon reaching their target thickness over the residual thickness of the carriers. This leads to continuously changing machining conditions. The achievable flatness of the semiconductor wafers is considerably impaired as a result. The material abrasion from the carriers moreover leads to an additional contamination of the semiconductor wafers with trace metals. In order to ensure a reliable guidance of the semiconductor wafers in the receiving openings of the carriers, the overhang of the semiconductor wafer over the residual thickness of the carrier that is subject to wear is not permitted to exceed specific maximum values. For some profile shapes of the edges of the semiconductor wafers, the total wear of the carrier is not permitted to exceed as little as 10 μm, since otherwise the semiconductor wafers leave the receiving openings of the carriers during machining and fracture occurs. Therefore, the wear of the carrier is a major problem in the case of lapping, as well.

For applications in chemomechanical double-side polishing with colloidal silica in alkaline dispersion, carriers having a coating composed of plasma-deposited diamond-like carbon (DLC) have been proposed (US 2005/0202758 A1). The DLC coating effectively prevents contamination of the semiconductor wafers by metal. However, the production of the DLC coating is extremely complicated and expensive and makes the entire polishing process very expensive overall.

In particular when using diamond abrasive, the carrier materials known in the prior art are subject to very high wear. The material abrasion from the carrier adversely affects the cutting capacity (sharpness) of the working layers. This leads to an uneconomically short lifetime of the carriers and necessitates frequent unproductive redressing of the working layers.

Furthermore, a very high degree of wear was observed in all carriers composed of plastics known in the prior art with fiber reinforcement. This wear amounted to at least three up to a few tens of micrometers decrease in thickness of the carrier per operating procedure with 90 μm material removal from the semiconductor wafer. As a result, the carriers can only be utilized for a small number of procedures, which is uneconomical.

It has furthermore been shown that additional double-side coatings known in the prior art without fiber reinforcement, e.g. by means of lacquer or wear protection coatings composed of EP, EP/AC, PU/AC, etc., as disclosed e.g. in U.S. Pat. No. 5,882,245, are all subject to a very high degree of wear. In the case of EP and EP-based mixed coatings, moreover, they led to particularly rapid blunting of the working layer.

In particular, specific hard coatings proved to be totally unsuitable as coating for carriers for carrying out the PPG method. By way of example, a carrier coated with 3 μm DLC which can be utilized for a few hundred to well over a thousand operating procedures when used in double-side polishing (DSP) with colloidally disperse alkaline silica sol (chemomechanical polishing) was completely eroded down to the bare metal surface after just a few seconds when used in a PPG method. Ceramic or other hard substance coatings prove to be just as unsuitable.

Finally, it has been shown that some of the coating materials applied to the carrier core are exposed to very high (frictional) forces which lead to detachment of coatings produced by means of layer application methods known in the prior art.

SUMMARY OF THE INVENTION

It was an object of the present invention to provide coated carriers which, when they are used in lapping, polishing and grinding machines, are subject to a particularly low degree of wear and whose coating adheres well to the carrier. These and other objects have been surprisingly achieved by means of a carrier for lapping, grinding and polishing machines, comprising a core composed of a first material which has a high stiffness, the core being completely or partly coated with a second material, and also at least one cutout for receiving a semiconductor wafer, wherein the second material is a polyurethane elastomer having a Shore A hardness of 20-90, preferably a thermoset polyurethane.

BRIEF DESCRIPTION OF THE DRAWINGS

The invention is explained with reference to figures below. The results were obtained by means of a method for the simultaneous double-side grinding of semiconductor wafers in which a multiplicity of carriers composed of different materials/coatings were tested. A corresponding method is described in DE 103 44 602 A1. A suitable apparatus for carrying out the method is disclosed e.g. in DE 100 07 390 A1.

FIG. 4 shows an exemplary embodiment of one carrier according to the invention with an opening for receiving a semiconductor wafer, comprising core, double-side coating and lining, (A) in an exploded illustration, (B) in a perspective illustration, (C)-(E) in a detail illustration of an excerpt from the contact zone between opening and lining.

DETAILED DESCRIPTION OF THE PREFERRED EMBODIMENT(S)

Figure 1:
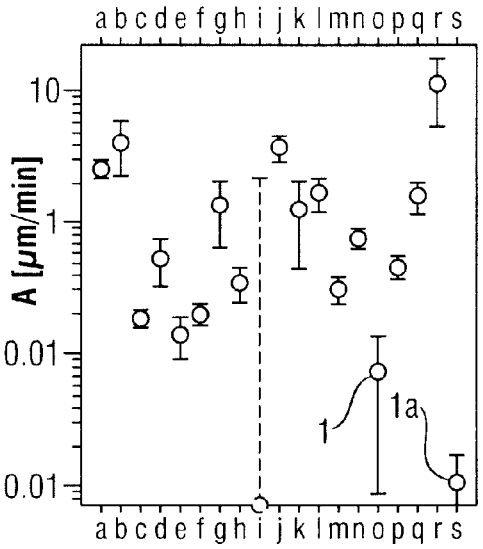
FIG. 1 shows the wear rate of carriers composed of various tested materials.

The invention also relates to a method for the simultaneous double-side material-removing machining of a plurality of semiconductor wafers, wherein each semiconductor wafer lies such that it is freely movable in a cutout of one of a plurality of carriers that are caused to rotate by means of a rolling apparatus and is thereby moved on a cycloidal trajectory, wherein the semiconductor wafers are machined in material-removing fashion between two rotating ring-shaped working disks.

The material-removing machining preferably involves a double-side grinding of the semiconductor wafers, wherein each working disk comprises a working layer comprising abrasive material. A double-side lapping of the semiconductor wafers with supply of a slurry comprising abrasive material is likewise preferred, as is a double-side polishing with supply of a dispersion comprising silica sol wherein each working disk comprises a polishing cloth as a working layer.

Table 1 shows an overview of the tested carrier materials. The first column specifies the reference symbols for assignment to the results that are presented below in FIG. 1, FIG. 2 and FIG. 3. Table 1 also specifies whether the carrier material that comes into contact with working layer and grinding slurry was present as a coating ("layer", for example applied by spraying, dipping, spreading, and, if appropriate, subsequent curing), as a film, or as a solid material. The second column specifies the type of carrier material investigated.

The abbreviations used in Table 1 denote: "GFP"=glass fiber reinforced plastic, "PPFP"=PP fiber reinforced plastic. The abbreviations for the various plastics are those which are generally conventional: EP=epoxy; PVC=polyvinylchloride; PET=polyethylene terephthalate (polyester), PTFE=polytetrafluoroethylene, PA=polyamide, PE=polyethylene, PU=polyurethane and PP=polypropylene, D-PU-E(60A)=thermoset polyurethane elastomer with 60 Shore A hardness. ZSV216 is the manufacturer's designation of a tested sliding coating and hard paper is a paper fiber reinforced phenolic resin. "Ceramic" denotes microscopic ceramic particles embedded into the EP matrix specified. "Cold" denotes application by means of a self-adhesive film on its rear side, and "hot" denotes a hot lamination process in which the film rear side equipped with hot melt adhesive was connected to the carrier core by means of heating and pressing. The "carrier load" column specifies the weight loading of the carrier during the wear test. The weight loading of the semiconductor wafer was 9 kg for all cases.

The materials having reference symbols a to n and p to r serve as comparative examples. Most of them are already known as materials for carriers in accordance with the prior art. All these materials a to n and p to r proved to be unsuitable for achieving the object(s) of the invention.

Carrier comprising material o (thermoplastic polyurethane) was suitable in principle but is not preferred in the context of the present invention since, as is shown below, it is inferior to carrier s having a coating composed of a thermoset polyurethane elastomer.

FIG. 1 shows the wear rate A [μm/min] of carriers comprising materials a to s which come into contact with the working layers. For each material, a set of carriers was produced and loaded with semiconductor wafers and grinding procedures, each case with identical material removal from the semiconductor wafers being carried out. The wear rate A of the carriers was calculated from the decrease in the thickness of the test materials of the carriers which come into contact with the working layers and the machining duration until reaching target removal from the semiconductor wafers. The decrease in thickness was determined by means of weighing before and after each grinding procedure and the known relative density of the test materials. A plurality of such test procedures were carried out for each carrier material.

Figure 2:
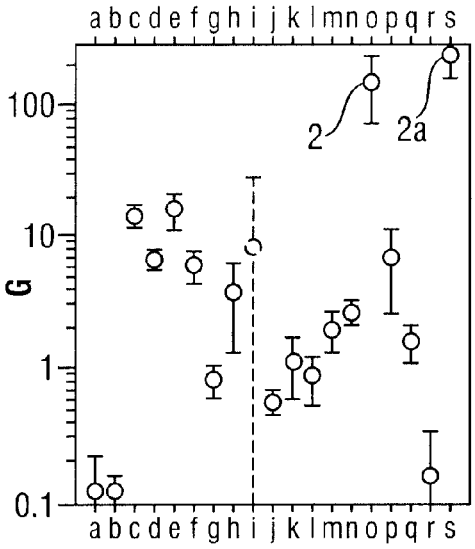
FIG. 2 shows the ratio of material removal from the semiconductor wafer and wear of the carrier for various tested materials of the carriers.
Figure 3:
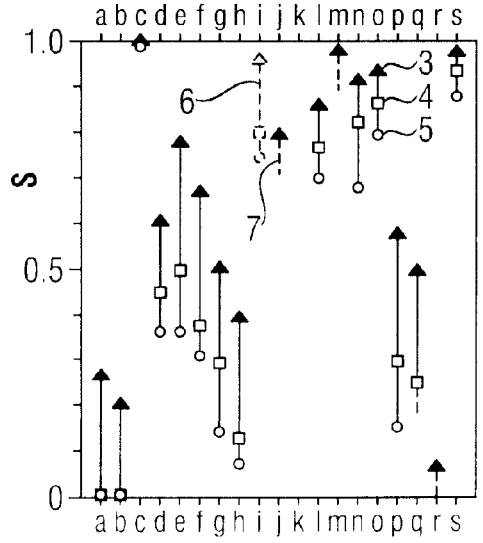
FIG. 3 shows the relative alteration of the cutting capacity of the working layer with the machining duration for various tested materials of the carriers.

The error bars in FIG. 1, FIG. 2 and FIG. 3 represent the range of variation of the individual measurements of the individual procedures relative to the average value over all the procedures (round data points). The scale of the y axis in FIG. 1 and FIG. 2 is chosen to be logarithmic since the wear rates of the various materials extend over several orders of magnitude.

TABLE 1

| Carrier materials | | | | | |
|---|---|---|---|---|---|
| Carrier material | | | | | Carrier |
| | | Application | | | |
| Abbreviation | Type | Layer | Film | Solid mater. | load [kg] |
| a | EP-GFP | | | X | 2 |
| b | EP-GFP | | | X' | 4 |
| c | PVC film | | X | | 2 |
| d | PVC film | | X | | 4 |
| e | PET (cold) | | X | | 2 |
| f | PET (hot) | | X | | 4 |
| g | EP-CFP | | | X | 4 |
| h | PP-GFP | | | X | 4 |
| i | PP-PPFP | | | X | 4 |
| j | Hard paper | | | X | 4 |
| k | PTFE II | X | | | 4 |
| l | PA film | | X | | 4 |
| m | PE (I) | X | | | 4 |
| n | PE (II) | X | | | 4 |
| o | PU | X | | | 4 |
| p | EP/ceramic | X | | | 4 |
| q | EP (Primer) | X | | | 4 |
| r | Sliding coat. ZSV216 | X | | | 4 |
| s | D-PU-E(60A) | X | | | 4 |

The carrier materials a to n and p to r are subject to a very high degree of wear (FIG. 1). Carriers composed of such materials have uneconomically short lifetimes and, on account of the continuous wear, lead to constantly changing process conditions since the overhang of the semiconductor wafers when reaching the target thickness over the remaining residual thickness of the carriers increases continuously from test procedure to test procedure.

Only the materials o (reference symbol 1) and in particular s (reference symbol 1*a*) have a high wear resistance. This becomes particularly clear in FIG. 2.

FIG. 2 indicates the ratio G of material removal from the semiconductor wafers obtained in a test procedure and the resultant decrease in the thickness of the carriers owing to wear for the tested materials. For material o, this "wear ratio" G (reference symbol 2) is more than one order of magnitude better than that of the next best material investigated. A further improvement is evident in the case of material s.

Finally, FIG. 3 indicates the reduction of the cutting capacity (sharpness) S of the working layer in units relative to a reference material (material c: PVC film with 2 kg test load). The sharpness is determined from the actual rates of material removal from the semiconductor wafers obtained with constant operating parameters (pressure, kinematics, cooling lubrication, working layer) in relation to the rates of material removal from the semiconductor wafers obtained under these conditions with the reference material. The working layer was freshly dressed and sharpened at the beginning of each test series with a carrier material, such that identical initial conditions were provided for each test series. A plurality of test grinding processes on the semiconductor wafers were then carried out with each carrier material and the resulting rates of material removal from the semiconductor wafers in μm/min were measured in each case after ten minutes (reference symbol 3), after 30 minutes (reference symbol 4) and after 60 minutes (reference symbol 5) total operating time and related to those of the reference material (likewise in μm/min). It is evident that most of the carrier materials have the effect that the working layers rapidly lose their initial cutting capacity directly after dressing and rapidly become blunt. These materials (a to n and p to r) are therefore unsuitable.

Only the materials o and in particular the material s according to the invention, exhibit a very small decrease in the cutting capacity of the working layers over the test duration. In the case of these materials, the decrease in the cutting capacity is determined only by the properties of the working layer used in the tests. The working layer was chosen to be relatively hard, such that it did not permit "self-dressing" operation. "Self-dressing" generally denotes the action when the resetting of the bonding of the abrasive tool on account of loading takes place at least as rapidly as the wear of the "working" abrasive grains situated freely at the surface, such that in a dynamic equilibrium the amount of new grain having a high cutting capacity that is released is always at least as much as is consumed on account of the wear during machining.

Only polyurethanes (o and s) are therefore suitable as carrier materials. Polyurethanes are a broad group of substances that comprises materials having extremely different properties. It is evident that only specific polyurethanes are particularly well suited:

The various polyurethane systems can be classified into hot or cold curing casting systems (thermoset polyurethanes) and solid systems that are processed by injection molding, extrusion or the like or by vulcanization (post-crosslinking) (thermoplastic polyurethanes). Both systems cover a broad hardness range depending on formulation and treatment. The thermoset polyurethanes, in particular, can be formulated with hardnesses of 60° Shore A to >70° Shore D. In the hardness range from approximately 20° Shore A to 90° Shore A, thermoset polyurethanes have elastomeric (rubber-like) properties (thermoset polyurethane elastomer, D-PU-E).

It is evident, then, that a material suitable for coating a carrier that can be used for carrying out the method according to the invention should have elastomeric properties. In particular, materials having a high tear strength (high initial tear and tear propagation resistance), elasticity (rebound elasticity), abrasion resistance and a low wet sliding friction resistance are advantageous. However, materials having these properties do not have a sufficient stiffness to withstand the forces that act on them during movement in the rolling apparatus. An increase in the stiffness by means of fiber reinforcement is unsuitable on account of the observed undesirable blunting effect of fibers on the working layers.

The inventors have recognized that carriers should be constructed in multilayer fashion and from different materials, namely:

a "core" composed of a first, stiff material, e.g. (hardened) (high-grade) steel, which imparts to the carrier a sufficient stability against the forces that act on the carrier when carrying out the method according to the invention;

a preferably double-side coating composed of a wear-resistant and soft second material; according to the invention, this is best afforded by a thermoset polyurethane elastomer; and preferably a third material, which lines the openings in the carrier for receiving the semiconductor wafers and prevents mechanical damage (splintering, fracture) or chemical (metal contamination) damage.

Exemplary embodiments of carriers are shown in FIG. 4 and FIG. 5.

FIG. 4 shows a carrier having an opening 11 for receiving a semiconductor wafer. A design of this type is produced if the semiconductor wafers are large and the apparatus used for carrying out the method according to the invention has working disks having a small diameter. This is the case for example for a two-disk precision grinding machine of type "AC-1500" from Peter Wolters A G, Rendsburg, whose two ring-shaped working disks have an external diameter of 1470 mm and an internal diameter of 561 mm and whose rolling apparatus for the carriers comprises an outer toothed ring having a pitch circle diameter of 1498.35 mm and an inner toothed ring having a pitch circle diameter of 532.65 mm, which results in a pitch circle diameter of 482.85 for the outer toothing of the carrier. (The root diameter of the outer toothing of the carrier is 472.45 mm.)

Such a carrier having an available diameter of ~470 mm, provided with corresponding openings, can receive e.g. precisely one semiconductor wafer having a diameter of 300 mm (FIG. 4), with up to three semiconductor wafers having a diameter of 200 mm (FIG. 5), up to five semiconductor wafers having a diameter of 150 mm, or up to eight semiconductor wafers having a diameter of 125 mm. Given correspondingly larger working disk dimensions and/or smaller semiconductor wafer dimensions, the carriers can receive correspondingly more semiconductor wafers.

FIG. 4 and FIG. 5 show preferred elements of carriers according to the invention:

the "core" 8 composed of a first material of high stiffness, which does not come into contact with the working layers and which imparts a mechanical stability to the carrier, such that it withstands the forces that act on it during the rolling movement between the working disks without plastic deformation;

a front-side coating (9*a*) and rear-side coating (9*b*) composed of a second material, which comes into contact with the working disks during the machining of the semiconductor wafer and which has a high wear resistance with respect to the action of bonded grain (working layer) and free grain (abrasive slurry, abrasion on account of material removal from the semiconductor wafers); and one or more linings 10 composed of a third material, which prevents a direct material contact between semiconductor wafer and core 8 of the carrier. The second material is preferably a thermoset polyurethane elastomer.

The carriers preferably have an outer toothing 16 corresponding to the rolling apparatus of the grinding apparatus, this rolling apparatus being formed from inner and outer toothed rings.

The front- and rear-side coatings 9*a* and 9*b* which come into contact with the working layers can be embodied over the whole area, that is to say completely cover the core 8 of the carrier on the front and rear sides, or they are embodied over part of the area in such a way that arbitrary free areas, e.g. 13 or 14, arise at front side (13*a*) and rear side (13*b*), but without the core 8 coming into contact with the working layers.

The carriers usually contain further openings 15, through which cooling lubricant can be exchanged between lower and upper working disks, such that upper and lower working layers are always at the same temperature. This counteracts an undesirable deformation of the working gap formed between the working layers through deformation of the working layers or working disks on account of thermal expansion under alternating load. In addition, the cooling of the abrasives bonded in the working layers is improved and becomes more uniform, and this prolongs the effective lifetime thereof.

The linings 10 of the carriers and the associated openings 11 of the carrier usually have matching outer (17*a*) and inner contours (17*b*) and are connected to one another by means of positive locking or adhesion (adhesive bonding) (17). FIG. 4(C) shows, in an enlarged illustration of an excerpt 18 from the carrier, various embodiments known in the prior art for the interconnection 17 between core 8 and lining 10 of the carriers: on the left by means of positive locking with undercuts (dovetail, JP 103 29 013 A2), in the middle with a smooth interface (interconnection by adhesive bonding, press-fitting, etc.; EP 0 208 315 B1), and on the right with a contact area enlarged by roughening for improved adhesion.

Figure 5A:
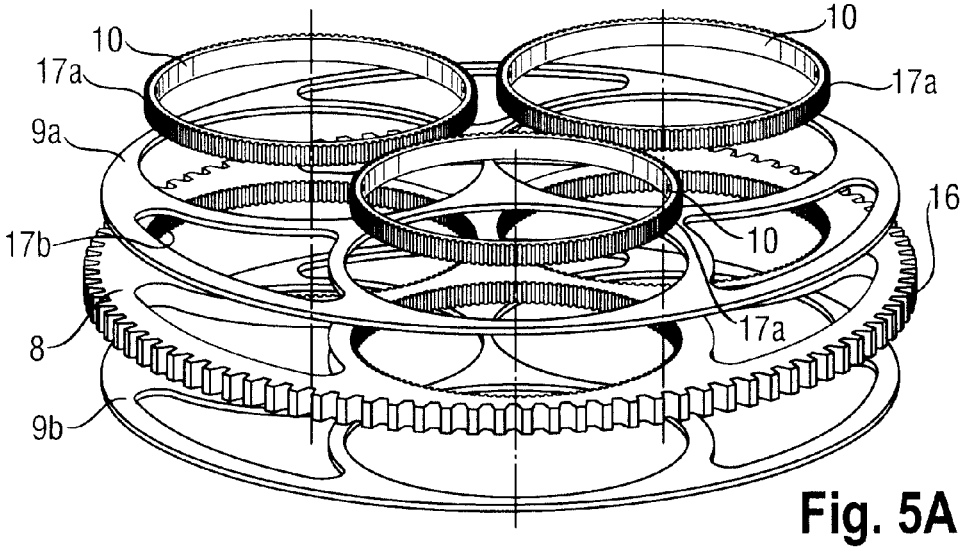
FIG. 5 shows an exemplary embodiment of one carrier according to the invention with three openings for receiving three semiconductor wafers, comprising core, double-side coating and lining, (A) in an exploded illustration, (B) in a perspective illustration, (C)-(G) in a detail illustration of a cross section through the contact zone between core, coating and lining of the carrier.
Figure 5B:
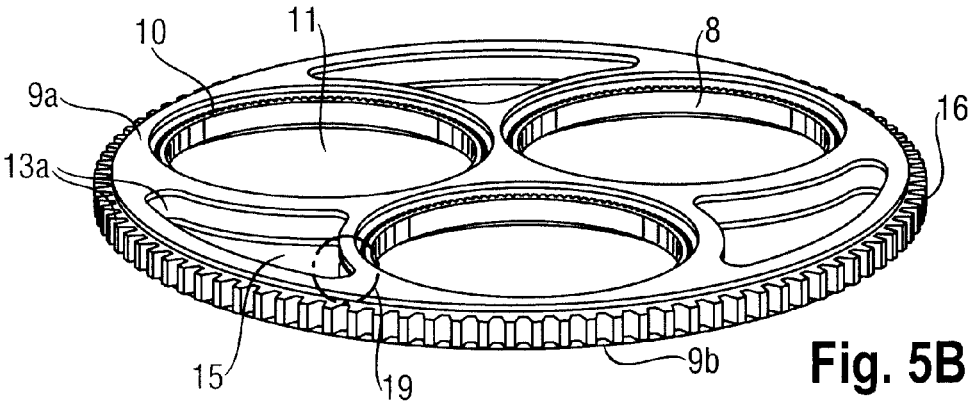
Figure 5C:
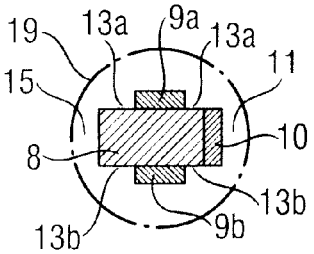

FIG. 5(C)-FIG. 5(G) indicate preferred embodiments for the coating 9 on the front side (9*a*) and rear side (9*b*) of the core 8 of the carrier and for the lining 10 of the receiving openings 11 for the semiconductor wafers. Each of the illustrations shows a small excerpt 19 from the carrier in cross section. FIG. 5(C) shows the above-described embodiment with partial-area coatings 9*a* and 9*b* and free areas 13*a* and 13*b* in the region of the cooling lubricant through opening 15 and the lining 10.

Figure 5D:
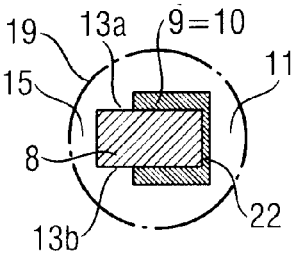

Embodiments of the carriers in which the third material for the lining of the receiving openings for the semiconductor wafers is also composed of a thermoset polyurethane elastomer are also particularly preferred. One exemplary embodiment in this respect is shown in FIG. 5(D). Here the coating 9 is led around the edge of the core 8 at the receiving opening 11 for the semiconductor wafer, such that it replaces the lining 10 (9=10).

Preferably, the layer thickness at the wall of the receiving opening 11 is chosen to be correspondingly thin (22), such that a sufficiently dimensionally stable guidance of the semiconductor wafer is ensured.

Figure 5E:
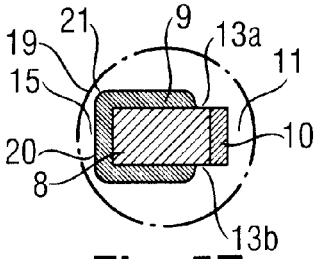

It is likewise preferred if the coating 9 is led around the edge of the core 8 at the cooling lubricant through openings 15 (20) (FIG. 5(E)). Leading the coating around the edges avoids sharp abutting edges. This reduces the requirements made of the material adhesion between layer and core, which has to be particularly good owing to the peel forces that occur.

Therefore, it is also particularly advantageous if the edges of the coating 9 are broken, that is to say e.g. rounded (21).

Figure 5F:
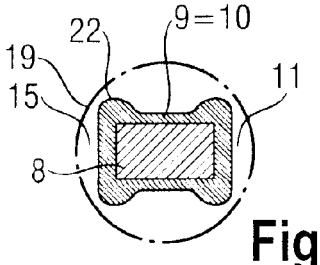

Furthermore, it is particularly preferred if the coating is made thicker at the locations at which it is subject to a higher degree of wear. These are primarily the outer regions of the carrier in the vicinity of the outer toothing, but also the edges at the cooling lubricant through openings 15 and the receiving openings 11 for the semiconductor wafers. The example of FIG. 5(F) shows a coating which is reinforced (22) both at the edge at the cooling lubricant through opening 15 and at the receiving opening 11 for the semiconductor wafer and which is additionally led around the edge of the receiving opening for the semiconductor wafer (9=10).

Figure 5G:
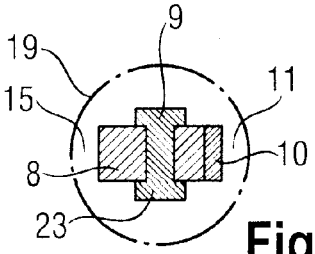

Finally, it is particularly preferred if the coating 9 embodied over the whole area or over part of the area of front side and rear side of the core 8 is connected to one another via openings 23 in the core, as illustrated in FIG. 5(G). These openings or "channels" 23 support the adhesion of the layer 9 by an additional positive locking. The coating 9 can then in particular also be embodied over part of the area in such a way that it is composed only of a plurality of individual "knobs" 9 having a small lateral extent, connected on the front/rear sides via holes 23. In this case, the holes 23 can have any desired cross sections, e.g. circular, angular, as "slots", etc.

It is evident that the core of the carrier must have a high stiffness and a high tensile strength in order to withstand the forces that occur during use in the rolling apparatus. In particular, a high modulus of elasticity has proven to be advantageous in order to avoid an excessive deformation of the carrier in the region of the outer toothing which is situated in each case in the "overhang" between working disk edge and toothing of the rolling apparatus and in which the carrier is not guided by the two working disks on the front and rear sides and held in a movement plane.

It has furthermore been found that the core should have a high strength (tensile strength $R_m$ or hardness) in order that in the event of deformation in the "overhang" and in particular under the action of the forces arising from the pins of the rolling apparatus on the tooth flanks of the carrier, the core of the carrier is not deformed plastically, e.g. as a result of the formation of bends or undulations or as a result of "flanging" of material at the tooth flanks.

It has been found that the modulus of elasticity of the material for the core of the carrier should preferably be greater than 70 GPa and the tensile strength should be greater than 1 GPa (corresponding to a Rockwell hardness of more than 30 HRC) in order to withstand the forces that occur during use in the rolling apparatus. The modulus of elasticity of the material for the core of the carrier is preferably 70-600 GPa and more preferably 100-250 GPa. The tensile strength is preferably 1-2.4 GPa (30-60 HRC) and more preferably 1.2-1.8 GPa (40-52 HRC).

The thermoset polyurethane elastomer preferably has a hardness of 40 Shore A to 80 Shore A.

The linings of the openings in the carrier for receiving the semiconductor wafers are preferably composed of a thermoplastic that can be processed by the high-pressure injection-molding method. Most preferably, the linings are composed of PVDF, PA, PP, PC (polycarbonate) or PET. Furthermore, linings composed of PS, PMMA (polymethyl methacrylate), perfluoroalkoxy (PFA), LCP and PVC are preferred.

The carrier preferably has a total thickness of between 0.3 and 1.0 mm.

The thickness of the stiff core imparting stability to the carrier is preferably between 30% and 98%, more preferably between 50% and 90%, of the total thickness of the carrier.

The coating preferably exists on both sides and is preferably of identical thickness on both sides of the carrier. Layer thicknesses for the double-side coating of the carrier of between a few micrometers (typically a few tens of micrometers) and a few hundred micrometers (typically 100 μm to 200 μm) therefore arise depending on the embodiment.

The object(s) of the invention are also achieved by means of a method for applying a polyurethane coating to a carrier comprising a metallic core and at least one cutout for receiving a semiconductor wafer, comprising the following steps: chemical activation of the core of the carrier by a treatment with an acid or an alkaline solution, application of an adhesion promoter, preferably an adhesion promoter containing a silane, to the carrier core that has been pretreated in this way, application of a polyurethane prepolymer to the adhesion promoter by means of potting, crosslinking and vulcanization to form a polyurethane layer. Preferably, the polyurethane layer is finally ground back to a desired target thickness.

It has been found that the uncrosslinked prepolymers of thermoset elastomer polyurethanes have a high viscosity and, depending on the formulation, in some instances very short processing times prior to commencement of the polyurethane crosslinking.

The term "prepolymer" denotes an uncrosslinked mixture of polyol, e.g., polyester or polyether polyol, polyisocyanate and crosslinkers (e.g. diols or amines), the subsequent crosslinking and vulcanization (post-curing) of which give rise to polyurethanes having the characteristic urethane group, —NH—CO—O—.

The short pot life generally permits only processing of the prepolymer by potting with minimum material thicknesses of a number of millimeters. Depending on the formulation and crosslinking behavior, this potting is effected as cold or hot potting.

Owing to the minimum material thicknesses that are a few millimeters thick, a coating produced by potting has such a high inherent stability that in the event of frictional loading of the coating (load parallel to the surface), expansion and compression (load perpendicular to the surface) at the interface with the substrate only tensile, compressive and shear forces occur which are relatively noncritical and impose comparatively minor demands on the adhesion between polyurethane coating and substrate.

In the case of layer thicknesses in the range of a few tens to hundreds of micrometers and low hardnesses of the layer of between e.g. 40° and 80° Shore A, by contrast, peel forces predominantly occur which impose particularly high demands on the adhesion between PU layer and carrier core. In this case, what proved to be a problem was not the adhesion at the interface between the adhesion promoter usually applied between substrate and coating and the PU coating, but rather the adhesion between substrate (metal core of the carrier) and adhesion promoter.

The adhesion promoter is firstly applied to the core of the carrier by means of spraying, dipping, flooding, spreading, rolling or blade coating and dried. The actual coating is then applied.

It was found that the customary pretreatment methods proposed for the adhesion promoters were inadequate for obtaining a sufficient adhesion of adhesion promoter and PU coating on the core of the carrier. Coatings wherein the carrier core had been pretreated before the application of adhesion promoter and PU coating by means of methods known in the prior art such as degreasing by cleaning in detergent solutions or by means of solvents, and enlargement of the adhesion surface by roughening, e.g. by incipient grinding or sandblasting, did not withstand the high peel forces that occur in use, and large-area detachments of the coating always occurred.

The mechanical pretreatments (grinding or sandblasting), in particular, proved to be particularly disadvantageous. Admittedly, the adhesion improved slightly, but not to a sufficient extent; however, the flatness of the carrier core deteriorated on account of roughness- and damage-induced asymmetrical strain. An undulatory carrier is undesirable since the semiconductor wafers then cannot be securely introduced into the receiving openings of the carriers and overlap the linings of the receiving openings in the edge region in some instances without being noticed, with the result that a fracture of the semiconductor wafer occurs when the upper working disk of the grinding apparatus is lowered.

Primarily, however, an undulatory carrier is subject to nonuniform wear. This shortens its period of utilization and is therefore uneconomical; in particular, however, locally different overhangs of the semiconductor wafers over the carrier arise, which restricts the cooling lubricant transport and the achievable flatness of the semiconductor wafers.

The adhesion problem between (metallic) core material and adhesion promoter interlayer was solved by chemical activation of the surface of the core material. The activation is preferably achieved by means of etching using acids or alkaline solutions.

By way of example, sodium hydroxide solution (NaOH) or potassium hydroxide solution (KOH), in particular concentrated NaOH or KOH, if appropriate with addition of a solvent, e.g. an alcohol (ethanol, methanol), are suitable. The activation is preferably effected by etching using acids, e.g. using hydrochloric acid (HCl), sulfuric acid ($H_2SO_4$), phosphoric acid ($H_3PO_4$), nitric acid ($HNO_3$) or a chloric acid ($HClO_3$, $HClO_4$).

The activation is most preferably effected by etching using an oxidizing acid, in particular nitric acid ($HNO_3$), with addition of fluoride ions (hydrofluoric acid, HF). Etching using oxidizing acids produces a reproducible oxide layer in particular also on high-grade steel, this oxide layer forming a particularly good adhesion base for the subsequent application of the adhesion promoter interlayer.

In addition, an activation of the surface of the metallic core material by means of low-pressure plasma, in particular using an oxygen plasma, is also possible.

The small layer thickness required can be obtained by way of uniform thick coating by means of potting and layer progression and grinding back after crosslinking and vulcanization of the thick layer to a target dimension by means of flat grinding. A double-side coating of the carrier core is achieved by sequentially machining just one and then the other side of the carrier core.

During crosslinking and vulcanization (post-curing), the polyurethane experiences a small degree of volume shrinkage. As a result, the layer produced is strained and the carrier becomes undulatory. After complete coating of both sides of the carrier, the stresses on both sides essentially compensate for one another. However, on account of the sequential coating of both sides, there always remains a certain residual stress and thus residual undulation of the finished coated carrier.

However, since the strains lead to long-wave residual undulations which are elastically compensated for during the use of the carrier without relatively high and locally greatly fluctuating restoring forces, carriers produced in this way are suitable for carrying out the method according to the invention. A simultaneous coating of both sides of the carrier core in a single machining step is advantageous, however. This can be done for example by potting and curing in a mold into which the carrier core is held in centered fashion. A simultaneous double-side coating ready to target thickness is particularly preferred.

A whole-area progression of the PU prepolymer in the mold can be achieved in a sufficient manner despite the increased viscosity of the PU prepolymer and the small layer thickness if the prepolymer is introduced into the mold under vacuum or by means of pressure.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A carrier, suitable for receiving one or more semiconductor wafers for the machining thereof in lapping, grinding or polishing machines, comprising a core composed of a first material which has a high stiffness, said core being completely or partly coated with a second material, and also at least one cutout for receiving a semiconductor wafer, wherein the second material is a thermoset polyurethane elastomer having a Shore A hardness of 20-90.

2. The carrier of claim 1, wherein the first material has a modulus of elasticity of 70-600 GPa.

3. The carrier of claim 1, wherein the first material has a modulus of elasticity of 100-250 GPa.

4. The carrier of claim 1, wherein the first material has a Rockwell hardness of HRC 30 to HRC 60.

5. The carrier of claim 1, wherein the first material has a Rockwell hardness of HRC 40 to HRC 52.

6. The carrier of claim 1, wherein the first material is a steel.

7. The carrier of claim 1, wherein the thermoset polyurethane elastomer has a hardness of Shore A 40 to Shore A 80.

8. The carrier of claim 1, wherein a cutout of the carrier is lined in its edge region with a third material selected from the group consisting of polyvinylidene difluoride (PVDF), polyamide (PA), polypropylene (PP), polyethylene (PE), polyethylene terephthalate (PET), polycarbonate (PC), polystyrene (PS), polymethyl methacrylate (PMMA), perfluoroalkoxy (PFA), and mixtures thereof.

9. The carrier of claim 1, wherein a cutout of the carrier is lined in its edge region with a thermoset polyurethane elastomer having a Shore A hardness of 20-90.

10. The carrier of claim 1, wherein a total thickness of the carrier is between 0.3 and 1.0 mm and a thickness of the core of the carrier composed of the first material is between 30% and 98% of the total thickness of the carrier.

11. The carrier of claim 1, wherein the thickness of the core of the carrier is between 50% and 90% of the total thickness of the carrier.

12. The carrier of claim 10, wherein the thickness of the layers composed of the second material is identical on both sides of the core.

13. The carrier of claim 10, wherein the coating is thicker in the region of some or all of the edges of openings in the carrier than in the remaining regions of the carrier.

14. A method for producing a carrier of claim 1 in which a carrier comprising a metallic core and at least one cutout is coated, comprising the following steps: chemically activating the core of the carrier by chemical treatment, electrochemical treatment or treatment with a plasma to form a pretreated core, applying an adhesion promoter to the pretreated core, applying a polyurethane prepolymer to the adhesion promoter by means of potting to form a polyurethane layer, and grinding the polyurethane layer to a target thickness.

15. The method of claim 14, wherein the polyurethane is applied to the core of the carrier on both sides simultaneously.

16. The method of claim 14, wherein the application of the polyurethane prepolymer takes place in a mold by means of vacuum or under pressure.

17. The method of claim 14, wherein the adhesion promoter contains a silane.

18. The method of claim 14, wherein a third material for lining an edge of a cutout is introduced by means of a high-pressure injection-molding method.

19. The method of claim 14, wherein the polyurethane coating is led completely or partly around some or all of the edges of openings or cutouts of the carrier in such a way that front-side coating and rear-side coating are connected to one another.

20. The method of claim 19, wherein activation is by chemical treatment with an acid or alkaline etchant solution.

21. The method of claim 20, wherein the etchant is selected from the group consisting of phosphoric acid ($H_3PO_4$), nitric acid ($HNO_3$), sulfuric acid ($H_2SO_4$), hydrofluoric acid (HF), hydrochloric acid (HCl) and mixtures thereof.

22. The method of claim 20, wherein an oxidizing agent additionally acts on the first material during etching.

23. A method for the simultaneous double-side material-removing machining of a plurality of semiconductor wafers, wherein each semiconductor wafer lies such that it is freely movable in a cutout of one of a plurality of carriers of claim 1 that are caused to rotate by means of a rolling apparatus and is thereby moved on a cycloidal trajectory, wherein the semiconductor wafers are machined in material-removing fashion between two rotating ring-shaped working disks.

24. The method of claim 23, wherein the material-removing machining includes a double-side grinding of the semiconductor wafers and each working disk comprises a working layer comprising abrasive material.

25. The method of claim 23, wherein the material-removing machining includes a double-side lapping of the semiconductor wafers with supply of a slurry comprising abrasive material.

26. The method of claim 23, wherein the material-removing machining includes a double-side polishing with supply of a dispersion comprising silica sol, wherein each working disk comprises a polishing cloth as a working layer.

* * * * *